United States Patent [19]

Plummer

[11] Patent Number: 4,819,912

[45] Date of Patent: Apr. 11, 1989

[54] RAMPED GUIDE FOR CAPSTAN

[75] Inventor: Jeffrey J. Plummer, Rockford, Ill.

[73] Assignee: Greenlee Textron Inc., Rockford, Ill.

[21] Appl. No.: 133,322

[22] Filed: Dec. 16, 1987

[51] Int. Cl.[4] ..... B66D 1/38

[52] U.S. Cl. ..... 254/266; 226/196; 242/47.12

[58] Field of Search ..... 254/213, 216, 225, 266, 254/333, 334, 371, 374, 383, 389; 242/47.01, 47.12, 117; 226/196

[56] References Cited

U.S. PATENT DOCUMENTS

| | | | |
|---|---|---|---|
| 13,429 | 8/1855 | Gesner | 254/334 |
| 23,499 | 4/1859 | Reed | 254/266 |
| 88,761 | 4/1869 | Willis | 242/117 |
| 1,175,384 | 3/1916 | Shinoe | 254/216 X |
| 1,734,832 | 11/1929 | Shanklin | 254/389 X |
| 2,497,220 | 2/1950 | Humberson | 242/47.12 X |
| 3,753,551 | 8/1973 | Tidwell | 254/334 |

FOREIGN PATENT DOCUMENTS

| | | | |
|---|---|---|---|
| 56909 | 8/1982 | European Pat. Off. | 254/383 |
| 964252 | 5/1957 | Fed. Rep. of Germany | 242/47.12 |

*Primary Examiner*—Joseph J. Hail, III

*Attorney, Agent, or Firm*—Richard A. Giangiorgi

[57] ABSTRACT

A guide for prevention of fouling of rope or cable wound on a capstan is a short helical ramp at the driven end of the capstan, which ramp guides the rope onto the cylindrical capstan body. The capstan rotates conventionally; the ramp is fixed concentrically. The ramp winds through an arc which is less than 360°. In another embodiment, an arm connects to the ramp. The ramp with connected arm, is free to rotate near the driven base of the capstan. The rotatable ramp/arm assembly allows the rope to approach the capstan from any radial angle and be properly wound onto the capstan.

14 Claims, 2 Drawing Sheets

FIG. 1
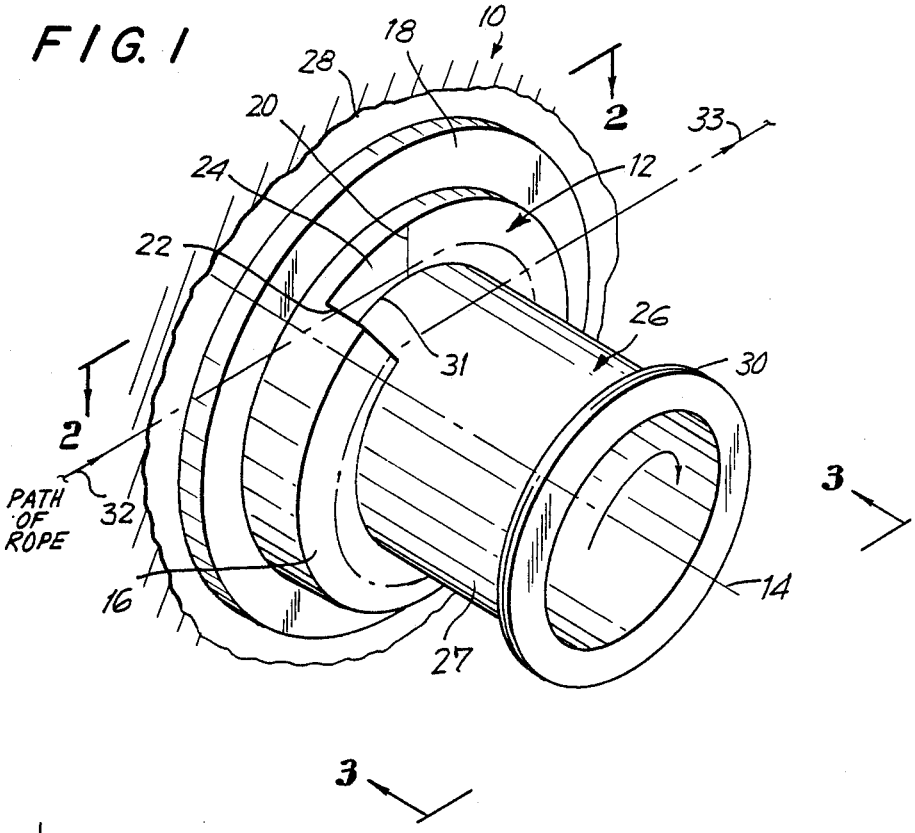
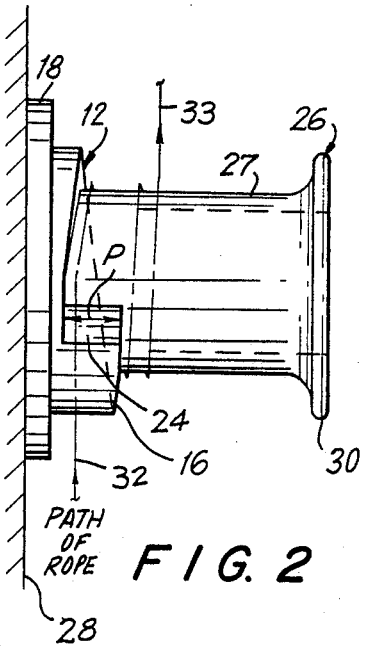
FIG. 2
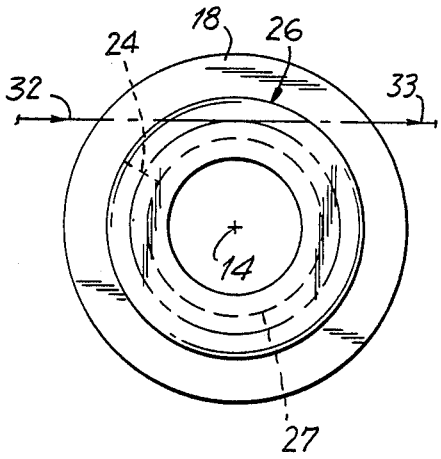
FIG. 3

FIG. 5
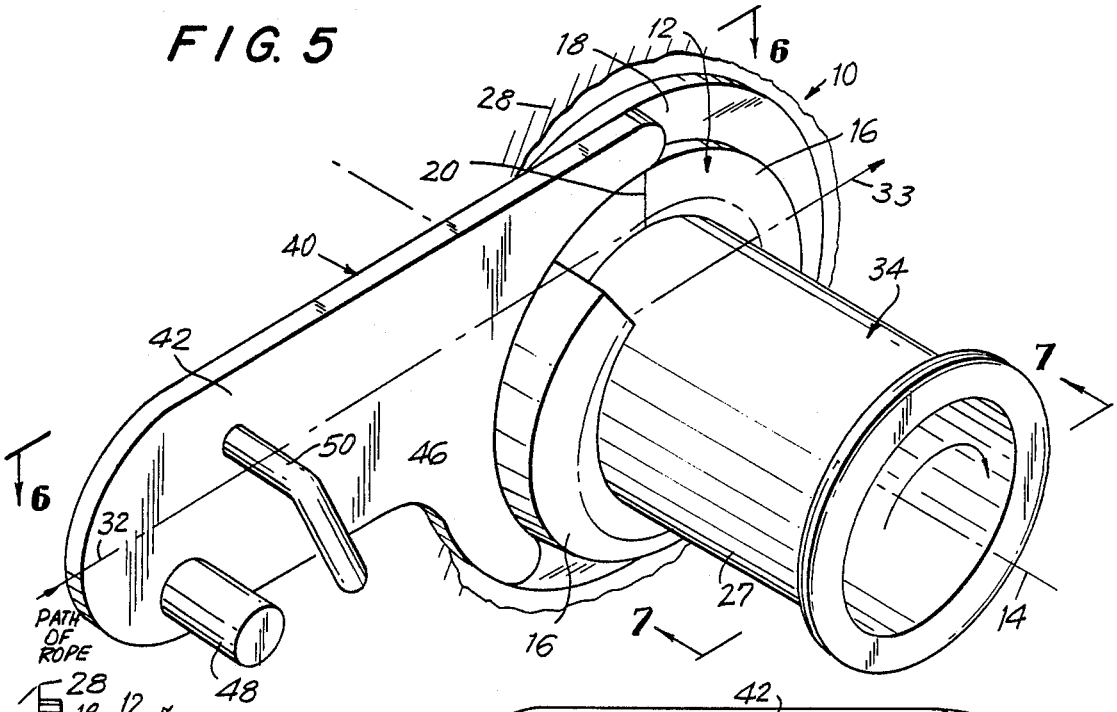
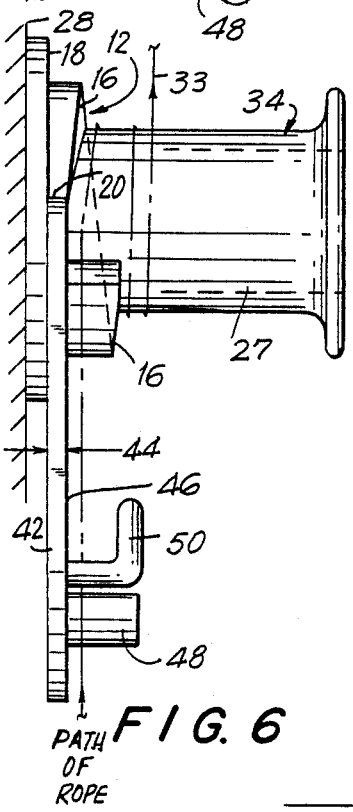
FIG. 6
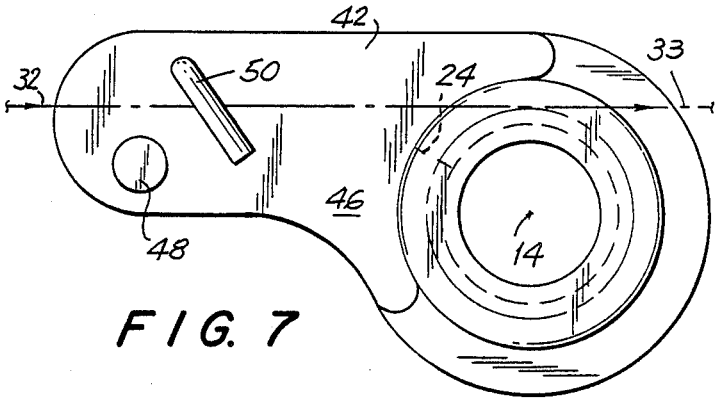
FIG. 7
FIG. 4
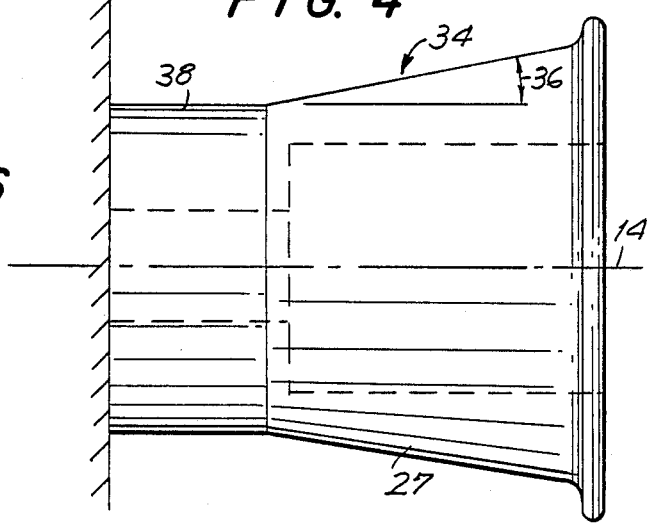

RAMPED GUIDE FOR CAPSTAN

BACKGROUND OF THE INVENTION

This invention relates generally to a guide device of the type used with a capstan to assure that rope or cable is properly wound on the capstan for pulling a load. By winding several turns of the rope or cable around a rotating capstan and pulling on the rope as it leaves the capstan, a tremendous mechanical advantage is achieved in proportion to the number of turns of the rope on the rotating capstan body. For effective operation, it is necessary that the turns of rope or cable lay down one next to the other without criss-crossing and overlapping on the capstan. An out-of-control hazardous condition can be created if such fouling of the line occurs and the power is not promptly removed from the capstan.

However, the greatest difficulty in using the capstan is getting the rope to lay down on the capstan surface in an orderly manner as it approaches the capstan.

What is needed is a guide for a capstan which urges the oncoming rope or cable onto the surface of the capstan body in an orderly manner without fouling or overlapping of the turns.

SUMMARY OF THE INVENTION

Generally speaking, in accordance with the invention, a guide for a capstan especially suitable for prevention of fouling of rope or cable wound on the capstan is provided. The guide is a short helical ramp located near the driven end of the capstan body, which ramp guides the rope before it lays onto and then circles around the cylindrical capstan body. The capstan rotates conventionally about its longitudinal axis; the ramp is concentric thereto but fixed in place. As the rope feeds onto the capstan surface adjacent to the ramp surface at the lowest level of the ramp, the ramp progressively urges the rope axially outward on the capstan body until termination of the ramp. There is sufficient axial space made available so that the incoming rope feeds along the capstan without interference from any subsequent wraps of rope or cable. The ramp is helical and winds through an arc which is less than 360°.

In another embodiment, an arm connects to the ramp. The ramp with connected arm, is free to rotate near the driven base of the capstan. The arm includes a pair of constraining means or pegs which guide the rope into the ramp. The ramp/arm assembly, rotatable around the capstan axis, allows the rope to approach the capstan from any radial angle and be properly wound onto the capstan.

Accordingly, it is an object of this invention to provide an improved ramped guide for a capstan which ramp guides rope onto the rotating capstan without fouling or overlapping of the rope loops.

Another object of this invention is to provide an improved ramped guide for a capstan which is adaptable for use with preexisting conventional capstans.

A further object of this invention is to provide an improved ramped guide for a capstan which accepts rope- feeding from any direction without fouling or overlapping of rope on the capstan.

Still other objects and advantages of the invention will in part be obvious and will in part be apparent from the specification.

The invention accordingly comprises the features of construction, combination of elements, an arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a top perspective view of a ramped guide in accordance with the invention assembled with a capstan;

FIG. 2 is a top view taken in the direction of the arrows 2—2 of FIG. 1;

FIG. 3 is an end view taken in the direction of the arrows 3—3 of FIG. 1;

FIG. 4 is a side view of a conventional capstan with an inverse taper;

FIG. 5 is a top perspective view of a ramped guide with extended arm in accordance with the invention for use with a capstan;

FIG. 6 is a top view taken in the direction of the arrows 6—6 of FIG. 5; and FIG. 7 is a front view taken in the direction of the arrows 7—7 of FIG. 5.

DESCRIPTION OF THE PREFERRED EMBODIMENTS

With reference to FIGS. 1–3, a ramped guide 10 in accordance with the invention includes a ramp 12 winding helically around a longitudinal axis 14, which axis is generally transverse to the outer surface 16 of the ramp 12. The ramp 12 is fixedly attached to a circular flange plate 18 and concentric therewith. The ramp 12 and flange plate 18 may be a single integral component.

The ramp surface 16 has a first end 20 and spirals away from the flange plate 18 as it circles the axis 14 to terminate at its second end 22 in a transition surface 24. From the first end 20 to the second end 22 of the ramp surface 16 there is a rise P away from the lowest level of the ramp surface 16 relative to the flange plate 18. Transition surface 24 includes a radial portion relative to the axis 14 and at a right angle thereto a flat portion which lies parallel to the surface of the flange plate 18. It should be understood that in alternative embodiments of ramps in accordance with the invention, the transition surface 24 need not be two right-angled portions as illustrated but may have any surface, preferably concave, which connects the second end 22 of the ramp surface 16 with the first end 20.

The ramp surface 16 spirals around the axis 14 in an arc which is less than 360° to avoid interference between the ramp and the in-coming rope. Satisfactory performance may be achieved with ramp surface arcs in the range of 225°–330° with a preference for 270°. The rise P of the ramp is selected based on the diameter of the rope or cable which is being pulled. The rise P equals or exceeds the diameter of the rope or cable to avoid any interference between turns as the rope approaches the ramped surface and winds its way outwardly along the capstan body as explained more fully hereinafter.

A capstan 26 extends from a mounting surface 28, for example, a wall, panel, bulkhead, etc. The capstan is not a novel portion of the invention and accordingly is not described in great detail herein. Nevertheless, it should be noted that the capstan 26 has a body 27 which may be at least partially hollow and a flared end 30. The capstan 26 is mounted for rotation by drive means, for example, a motor (not shown) mounted behind the mounting surface 28 in a conventional manner such that the capstan 26 can be driven in rotation around the longitudinal axis 14.

In use, the ramped guide 10 including the ramp 12 and flange plate 18 are fixedly attached to the mounting surface 28 by any known means, e.g. bolts, rivets, with the capstan passing concentrically through a central opening 31 in the ramped guide 10. Thus, when combined, the capstan 26 is free to rotate conventionally about the axis 14, whereas the concentrically positioned ramp 12 and its outer surface 16 are fixed relative to the mounting surface 28.

In operation, a rope or cable feeds onto the capstan by making contact with the capstan body 27 and the ramp surface 16 near the first end 20 of the surface 16 as best seen in FIG. 2. It should be noted in the FIGS. that the path 32–33 of the rope or cable is indicated by a broken line which represents the center line of the rope, the rope itself not actually being shown in the drawings. As the rope winds around the capstan body 27, it is urged by the ramp surface 16 away from the flange plate 18. As one turn of rope is near completion on the capstan body 27, a spacing P is provided by the ramp 12 such that turns of rope or cable may be continuously wound on the capstan body 27 as the operator (not shown) determines. The operator applies force to the rope leaving the capstan (reference numeral 33) after the desired number of turns have been made. The magnitude of load (not shown) which can be pulled by the rope and capstan 26 depends upon the force applied by the operator and the mechanical advantage achieved through use of the capstan, said mechanical advantage increasing as the number of turns on the body 27 of the capstan are increased. Frictional engagement, in the known manner, between the capstan body 27 and the rope loops provides a force which pulls the load attached at the end of the rope. When the operator releases tension on the rope, which is leaving the capstan as indicated at reference numeral 33, there is slippage between the capstan body 27 and the rope and less load pulling force, if any, is provided.

When the operator releases tension on the leaving rope, there is a tendency for the turns already on the capstan body 27 to become fouled and overlapped due to the action of the ramp 12 which continues to urge the rope away from the mounting surface 28. To alleviate this problem, it is known to use a capstan 34 as illustrated in FIG. 4 which has an inverse taper, that is, the diameter of the capstan increases with distance from the mounting surface 28. A cylindrical bearing surface 38 fits through the opening 31 in the ramped guide 10 with a loose fit so that rotation of the capstan is unimpeded. The inverted taper on the capstan 34 forces the turns of rope toward the flange plate 18 as the operator releases tension on the end 33 of the rope leaving the surface of the capstan. The ramp surface 16, as stated previously, pushes the turns in the opposite direction. Thus, the opposing forces tend to neutralize each other and the turns do not become fouled or overlapped when the operator properly reduces tension on the rope. Thereby, the capstan 34 may rotate while the rope slips without pulling the load. For ropes having diameters up to one inch, a dimension P of one inch, a ramp surface 16 extending helically for 270° around the axis 14, and a capstan 34 with an opening angle 36 of 5°, have proved satisfactory in performance. The opening angle 36 may effectively be in a range of 2°–15°.

FIGS. 5–7 illustrate an alternative embodiment of a ramped guide for capstan in accordance with the invention. The assembly differs from that illustrated in FIGS. 1–3 by addition of an arm assembly 40 to the ramped guide 10 of FIGS. 1–3. The arm assembly 40 includes an arm 42 which is fixedly attached to the flat surface of the flange plate 18 or to the outer periphery of the ramp 12 by any suitable means, for examples, welding, bolts, rivets, etc. As best illustrated in FIG. 6, the arm 42 has a thickness 44 such that the inner surface 46 of the arm 42 makes a substantially tangential projection over the first end 20 of the ramp surface 16. Thus a rope sliding along the surface 46 of the arm 42 toward the capstan and ramp 12 finds a smooth transition from one surface to the other.

A first constraining peg 48 extends from the inner surface 46 of the arm 42 and a second constraining peg 50 extends from the same surface and bends over generally toward the peg 48 to provide a passage for the rope between the two pegs 48, 50 as best illustrated in FIG. 7. The bend in peg 50 tends to constrain the rope from moving outward in the direction of the axis 14. The pegs 48, 50 are positioned on the arm 42 to feed a rope into a position which is tangential to the body 27 of the capstan at the first end 20 of the ramp surface 16. Thus, the rope is fed through the constraining pegs 48, 50 and approaches the capstan surface at the location where the ramp 12 begins to wind away from the flange plate 18.

Whereas in the embodiment of FIGS. 1–3, the ramped guide assembly 10 is fixed to the mounting surface 28 while the capstan 26 rotates on an axis perpendicular to the mounting surface 28, in the embodiment of FIGS. 5–7, the combined assemblies, that is, the arm assembly 40 and the ramped guide assembly 10, are not fixed relative to the mounting surface 28. The combined assembly is free to rotate with a loose fit on the cylindrical bearing surface 38 of the capstan 34. The inverted taper on the capstan 34 prevents the ramped guide assembly 10 with the arm assembly 40 attached from the sliding out toward the flared end of the capstan 34. Because the combined assemblies 10, 40 can rotate about the axis 14 on the capstan 34, the arm aligns to the rope feeding onto the capstan without regard to the radial direction from which the rope is fed. The arm 42 rotates about the axis 14 until the rope feeds tangentially onto the body surface of the capstan at the first end 20 of the ramp surface 16. When the capstan 34 is driven, there is a tendency for the arm to swing in a clockwise direction causing the rope to ride on the lower peg 48. Accordingly, as illustrated in the FIGS., it may be desirable to use a larger diameter for peg 48 than for peg 50 which serves primarily to provide axial constraint to the rope.

Use of the embodiment illustrated in FIGS. 5–7 is as described for the embodiment of FIGS. 1–3. The inverted taper of the capstan 34, as previously stated, constrains the guided ramp assembly 10 from axial movement and also restrains the rope loops in proper position when the operator reduces tension on the rope leaving the capstan.

The guided ramp assembly 10 and the arm 40 are made of a rigid material, for example, aluminum.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings, shall be interpreted as illustrative and not a limiting sense.

It is also to be understood that the following claims are intended to cover all of the generic and specific features of the invention herein described, and all statements of the scope of the invention which, as a matter of language, might be said to fall therebetween.

What is claimed is:

1. A guide for laying turns of rope or cable on a capstan, said capstan being positioned on a mounting surface and including a generally cylindrical body mounted for rotation relative to said mounting surface about the longitudinal axis of said body, comprising:

a ramp concentric with said axis and extending away from said mounting surface in a helix, said ramp having a first end and a second end, said first end being closer to said mounting surface then said second end; and a transition surface extending from said second end of said ramp toward said mounting surface, said transition surface terminating at a distance from said mounting surface equal to the distance of said first end from said mounting surface, a flange plate, said plate having a circular opening and being fixedly connected to said ramp for positioning intermediate said ramp and said mounting surface, said circular opening being concentric with said ramp and sized to allow passage of said cylindrical capstan body therethrough, and an arm connected to at least one of said ramp and flange plate, said arm extending transversely to said rotational axis, and entrapment means connected to said arm for constraining said rope to said arm as said rope advances toward said capstan for winding therearound.

2. A guide as claimed in claim 1, wherein said helix is cylindrical.

3. A guide as claimed in claim 2, wherein said helix extends in a range of 220°–330° of circular arc about said axis.

4. A guide as claimed in claim 2, wherein said helix has a pitch at least equal to the diameter of said rope.

5. A guide claimed in claim 2, wherein said helix extends 270° around said axis.

6. A guide as claimed in claim 1, wherein said transition surface includes a first portion radial to said axis and a second portion parallel to said mounting surface.

7. A guide as claimed in claim 1, wherein said entrapment means include at least two pegs spaced apart and extending transversely from said arm, in use of said guide, the rope or cable passing between said at least two pegs and advancing to said capstan.

8. A guide as claimed in claim 7, wherein one said peg is bent to constrain lateral motion of said rope or cable away from said arm and said mounting surface.

9. A guide as claimed in claim 8, wherein said pegs are round and of different diameters.

10. A guide as claimed in claim 1, wherein said helix extends 270° around said axis.

11. A guide for laying turns of rope or cable on a capstan, said capstan being positioned on a mounting surface and including a generally cylindrical body mounted for rotation relative to said mounting surface about the longitudinal axis of said body, comprising:

a ramp concentric with said axis and extending away from said mounting surface in a helix, said ramp having a first end and a second end, said first end being closer to said mounting surface then said second end; and a flange plate, said plate having a circular opening and being fixedly connected to said ramp for positioning intermediate said ramp and said mounting surface, said flange plate and said ramp being rotatably mounted with respect to said mounting surface, said circular opening being concentric with said ramp and sized to allow passage of said cylindrical capstan body therethrough, and an arm connected to at least one of said ramp and flange plate, said arm extending transversely to said rotational axis, and guide means on said arm for guiding said rope along said arm as said rope advances toward said capstan for winding therearound.

12. A guide as claimed in claim 11, wherein said arm extends perpendicularly to said rotational axis and a surface of said arm is substantially tangential to said ramp at said first ramp end, said guide means being connected to said arm surface.

13. A guide as defined in claim 11, further including a transition surface extending from said second end of said ramp toward said mounting surface, said transition surface terminating at a distance from said mounting surface equal to the distance of said first end from said mounting surface.

14. A guide as claimed in claim 11, wherein said guide means includes entrapment means comprising at least two pegs spaced apart and extending transversely from said arm, in use the rope or cable passing between said at least two pegs and advancing to said capstan.

* * * * *